US007389629B2

(12) United States Patent
Tretina

(10) Patent No.: US 7,389,629 B2
(45) Date of Patent: Jun. 24, 2008

(54) PORTABLE VACUUM PUMP FOR USE WITH RECLOSABLE, EVACUABLE CONTAINERS

(75) Inventor: Paul Tretina, Glen Allen, VA (US)

(73) Assignee: Reynolds Foil Inc., Richmond, VA (US)

( * ) Notice: Subject to any disclaimer, the term of this patent is extended or adjusted under 35 U.S.C. 154(b) by 0 days.

(21) Appl. No.: 11/757,845

(22) Filed: Jun. 4, 2007

(65) Prior Publication Data

US 2007/0209326 A1 Sep. 13, 2007

Related U.S. Application Data

(60) Division of application No. 11/556,377, filed on Nov. 3, 2006, now abandoned, and a continuation-in-part of application No. 11/186,131, filed on Jul. 20, 2005.

(60) Provisional application No. 60/862,396, filed on Oct. 20, 2006, provisional application No. 60/609,920, filed on Sep. 15, 2004, provisional application No. 60/602,685, filed on Aug. 19, 2004, provisional application No. 60/590,858, filed on Jul. 23, 2004.

(51) Int. Cl.
*B65B 31/02* (2006.01)

(52) U.S. Cl. ..... 53/512; 53/79; 53/432; 53/434; 53/510; 99/472; 141/65

(58) Field of Classification Search ..... 53/432, 53/434, 510, 512, 79, 403, 405, 408; 99/472; 141/65

See application file for complete search history.

(56) References Cited

U.S. PATENT DOCUMENTS

| | | | | | |
|---|---|---|---|---|---|
| 4,542,557 | A | * | 9/1985 | Levine | 15/344 |
| 4,678,014 | A | | 7/1987 | Owen et al. | 141/67 |
| 4,745,730 | A | | 5/1988 | Bartle, Sr. | 53/405 |
| 4,892,517 | A | | 1/1990 | Yuan et al. | 604/74 |
| 4,975,028 | A | | 12/1990 | Schultz | 417/442 |
| 4,984,611 | A | * | 1/1991 | Takatsuki et al. | 141/65 |
| 5,031,785 | A | | 7/1991 | Lemme | 215/228 |
| 5,121,590 | A | | 6/1992 | Scanlan | 53/510 |
| 5,215,445 | A | | 6/1993 | Chen | 417/313 |
| 5,228,271 | A | | 7/1993 | Wallace | 53/434 |
| 5,287,680 | A | | 2/1994 | Lau | 53/512 |
| 5,332,095 | A | | 7/1994 | Wu | 206/524.8 |
| 5,396,751 | A | * | 3/1995 | Chi | 53/510 |
| 5,480,030 | A | | 1/1996 | Sweeney | 206/524.8 |
| 5,513,480 | A | * | 5/1996 | Tsoi | 53/510 |
| 5,542,921 | A | | 8/1996 | Meyers et al. | 604/74 |

(Continued)

FOREIGN PATENT DOCUMENTS

WO PCT/US2006/019818 5/2006

*Primary Examiner*—Thanh K. Truong
(74) *Attorney, Agent, or Firm*—Greenberg Traurig LLP

(57) ABSTRACT

A portable vacuum unit for use with a resealable, evacuable container, comprising a vacuum pump housed within a body, an accumulator removably coupled to the body and in fluid communication with a vacuum port of the body, the accumulator comprising a receptacle, a tip, wherein a first end of the tip is coupled to a first end of the receptacle and in fluid communication therewith, the tip having a shape which facilitates interaction with a valve on the resealable, evacuable container, the tip comprising at least one support structure and a semi-rigid material coupled to a second end of the tip.

18 Claims, 5 Drawing Sheets

U.S. PATENT DOCUMENTS

| | | | | |
|---|---|---|---|---|
| 5,765,608 | A | 6/1998 | Kristen | 141/198 |
| 5,795,001 | A | 8/1998 | Burke | 294/64.1 |
| 5,836,046 | A * | 11/1998 | Huffman et al. | 15/321 |
| 5,931,189 | A | 8/1999 | Sweeney | 137/512.15 |
| 6,090,065 | A | 7/2000 | Giles | 604/74 |
| 6,423,387 | B1 | 7/2002 | Zollinger et al. | 428/341 |
| D467,048 | S | 12/2002 | Masaki | D32/17 |
| 6,520,071 | B1 | 2/2003 | Lanza | 99/472 |
| 6,604,634 | B2 | 8/2003 | Su | 206/524.8 |
| 6,673,036 | B1 | 1/2004 | Britto | 604/74 |
| 6,679,677 | B2 | 1/2004 | Yamauchi | 415/90 |
| 6,799,506 | B2 * | 10/2004 | Tarlow | 99/472 |
| 6,964,519 | B2 | 11/2005 | ErkenBrack | 383/60 |
| 6,971,417 | B2 | 12/2005 | Deni | 141/65 |
| 7,021,034 | B2 * | 4/2006 | Higer et al. | 53/512 |
| D525,823 | S | 8/2006 | Littmann | D7/368 |
| D527,502 | S | 8/2006 | Yoshimoto et al. | D32/18 |
| 7,086,211 | B2 * | 8/2006 | Bassett et al. | 53/434 |
| 7,096,893 | B2 | 8/2006 | Vilalta et al. | 141/65 |
| 7,127,875 | B2 | 10/2006 | Cheung | 53/510 |
| 7,128,735 | B2 | 10/2006 | Weston | 604/503 |
| 7,272,919 | B2 * | 9/2007 | Cheung | 53/510 |
| 2002/0183718 | A1 | 12/2002 | Morton et al. | 600/573 |
| 2003/0149398 | A1 | 8/2003 | Renz et al. | 604/74 |
| 2004/0177771 | A1 | 9/2004 | Small et al. | 99/472 |
| 2005/0025396 | A1 | 2/2005 | ErkenBrack | 383/60 |
| 2005/0039421 | A1 | 2/2005 | Cheung | 53/510 |
| 2005/0172577 | A1 | 8/2005 | Oltrogge | 53/434 |
| 2005/0244083 | A1 | 11/2005 | McMahon et al. | 383/63 |
| 2006/0029300 | A1 | 2/2006 | Yoder | 383/64 |
| 2006/0048483 | A1 | 3/2006 | Tilman et al. | 206/524.8 |
| 2006/0201576 | A1 | 9/2006 | Domenig | 206/524.8 |
| 2006/0213148 | A1 | 9/2006 | Baptista | 53/343 |
| 2006/0248861 | A1 | 11/2006 | Cheung | 53/510 |

* cited by examiner

PORTABLE VACUUM PUMP FOR USE WITH RECLOSABLE, EVACUABLE CONTAINERS

This application is a divisional of U.S. patent application Ser. No. 11/556,377, filed Nov. 3, 2006, now abandoned which claims the benefit of Provisional U.S. Patent Application Ser. No. 60/862,396, filed Oct. 20, 2006, and is a continuation-in-part of U.S. patent application Ser. No. 11/186,131, filed Jul. 20, 2005, which is related to and claims the benefit of Provisional U.S. Patent Application Ser. Nos. 60/590,858 filed Jul. 23, 2004, 60/602,685 filed Aug. 19, 2004, and 60/609,920 filed Sep. 15, 2004, all of which are hereby incorporated by reference in their entirety.

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

FIELD

The instant disclosure relates to the field of vacuum pumps for use with flexible containers, and more particularly, for hand-held vacuum pumps for use with resealable, disposable, evacuable plastic bags.

BACKGROUND

Plastic materials have several characteristics that make them advantageous for use in a wide variety of applications. For example, many plastic materials are relatively inert, and can thus be used to store a variety of materials, including foodstuffs. Plastics also have a relatively high strength to weight ratio, can be made opaque or transparent, and can be made water and/or air tight. Because of these characteristics, plastics are used in almost every aspect of modern life.

One such use of plastics is as storage containers, and especially food storage bags. Because plastic is inert, plastic food storage bags can be used to store acidic foods, such as those containing tomato sauces, vinegars, and the like, for extended periods of time without concern that the bag will break down. The food storage bags can also be made essentially transparent, thereby permitting a user to easily see what is stored inside the bag. The high strength to weight ratio also means that the bag can store relatively heavy foods, such as meats, dense vegetables, and the like, without fear of the bag breaking while the bag and its contents are being moved. In addition, given the waterproof nature of such plastic bags, they are ideal for containing both solids and liquids.

One problem with plastic food storage bags is that they trap air inside the bag with the food. Such air provides oxygen, water, and other chemicals needed by bacteria and other microorganisms to facilitate breaking down (i.e. spoiling) of the bag's contents. The air also allows ice crystals to form on the food when the bag is placed in a freezer. Such ice crystals can cause "freezer burn", which is undesirable for consumers.

Some in the prior art, such as the Food Saver line of plastic food storage bags and related equipment distributed by Jarden Corporation of Rye, N.Y., have addressed this by creating a bag whose open end is placed into a specialized apparatus. The apparatus draws the air from the bag though the open end, and then electronically welds the plastic bag closed. Although such a system is advantageous, the bags are essentially one-time-use products, are sometimes awkward to handle, and cannot be resealed.

SUMMARY

U.S. patent application Ser. No. 11/168,131, assigned to the assignee of the instant disclosure, describes, in one embodiment, a resealable, evacuable bag for storing food and the like comprising a valve incorporated into the wall of the bag, a stand-off structure which facilitates airflow within the bag, and a resealable closure. The instant disclosure relates to a portable vacuum pump unit for use with such bags and other containers that facilitates opening the valve and drawing air, liquids, and/or other fluids from the bag. Accordingly, the instant disclosure is directed to a portable vacuum pump unit that substantially obviates one or more of the problems due to limitations and disadvantages of the related art.

Additional features and advantages will be set forth in the description which follows, and in part will be apparent from this disclosure or may be learned by practice thereof. The objectives and other advantages will be realized and attained by the structure particularly pointed out in this written description, including any claims contained herein and the appended drawings.

An embodiment of portable vacuum unit for use with a resealable, evacuable container, comprises a body, wherein a vacuum pump is housed within the body, the vacuum pump comprising an intake port and an exhaust port, wherein the body comprises a vacuum port in fluid communication with the intake port of the vacuum pump, and wherein the body further comprises an exhaust port in fluid communication with the exhaust port of the vacuum pump; an accumulator, wherein the accumulator is removably coupled to the body and in fluid communication with the vacuum port of the body, the accumulator comprising: a receptacle comprising a first end and a second end; and, a tip comprising a first end and a second end, wherein the first end of the tip is coupled to the first end of the receptacle and in fluid communication therewith, the tip having a shape which facilitates interaction with a valve on the resealable, evacuable container, the tip comprising: at least one support structure; and, a semi-rigid material coupled to a second end of the tip.

In an embodiment, an adhesive may couple the semi-rigid material to the second end of the tip. In an embodiment, suitable semi-rigid material can include, without limitation, black nitrile (Buna-N) elastomer with a nominal 70 durometer hardness, neoprene, silicone, or other lower durometer flexible material, and may take the form of an O-ring. In an embodiment, the O-ring may be press-fit into a channel in the tip.

In an embodiment, the tip may comprise a plurality of support structures. Such support structures may include, but are not limited to, a plurality of ribs.

In an embodiment, the accumulator may further comprise a liquid separator, wherein the liquid separator is in fluid communication with the tip and the vacuum port of the pump body.

In an embodiment, the first end of the tip can be coupled to the first end of the receptacle by way of a flexible conduit.

In an embodiment, the vacuum pump can be powered by one or more rechargeable and/or disposable batteries, which can be stored within the pump body.

In one embodiment, manufacturing efficiencies can be realized by adding the semi-rigid material to the pump tip, rather than to the valve, because only a single application of the semi-rigid material is necessary on the pump tip. By contrast, essentially the same quantity of semi-rigid material must be added to each valve on each bag. Although such manufacturing efficiencies can present a significant cost savings, in an embodiment, the semi-rigid material may be applied as a surface treatment or adhered to the valve, thus obviating the need for such material on the pump tip.

BRIEF DESCRIPTION OF THE DRAWINGS

The accompanying drawings, which are included to provide a further understanding of the disclosed portable vacuum pump unit and are incorporated in and constitute a part of this specification, illustrate various embodiments and, together with the description, serve to explain the principles of at least one embodiment of the disclosed portable vacuum pump unit.

In the drawings.

DETAILED DESCRIPTION

Reference will now be made in detail to embodiments of the disclosed vacuum pump interface, examples of which are illustrated in the accompanying drawings.

Figure 1:
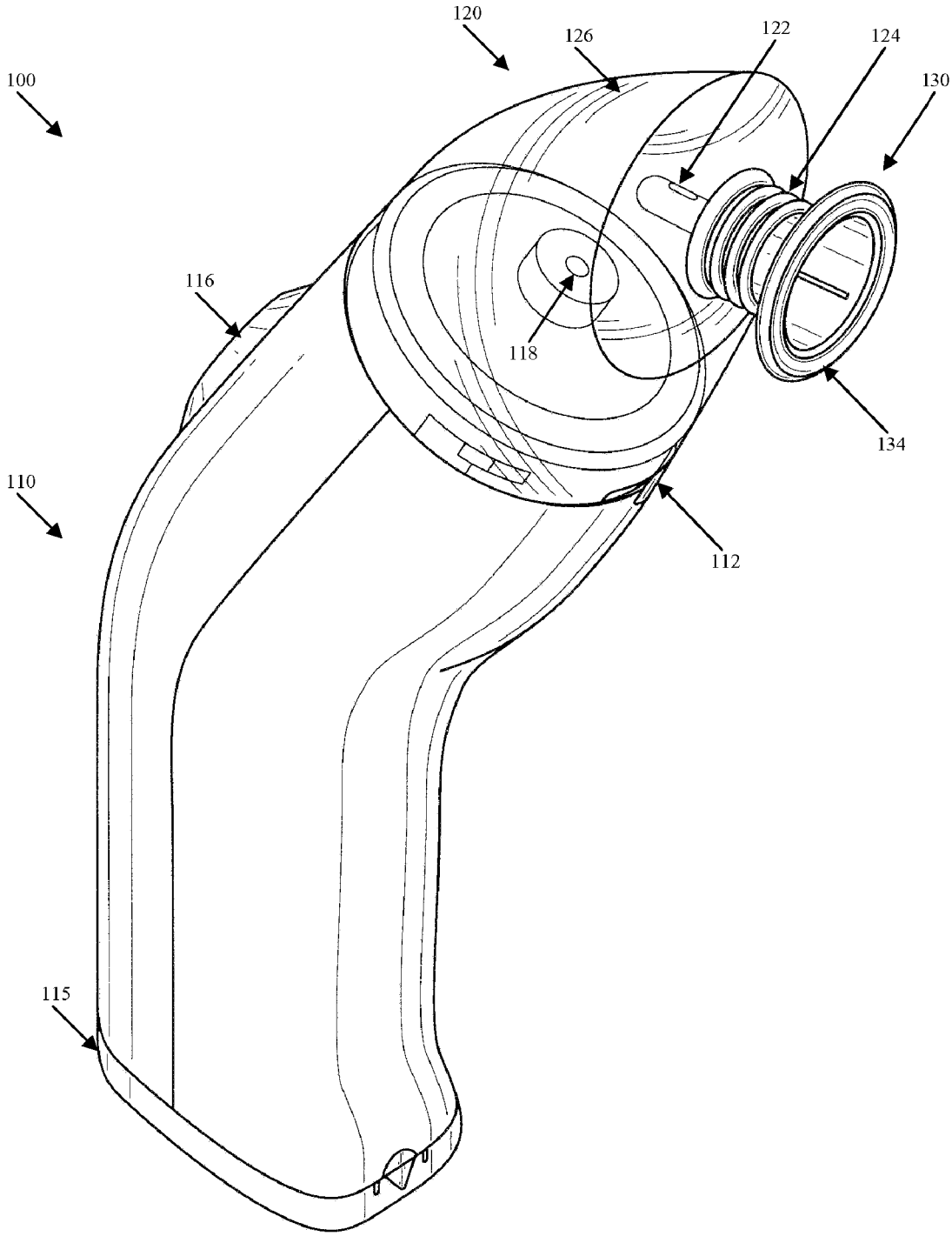
FIG. 1 is a perspective view of an exemplary vacuum pump unit embodiment.
Figure 2:
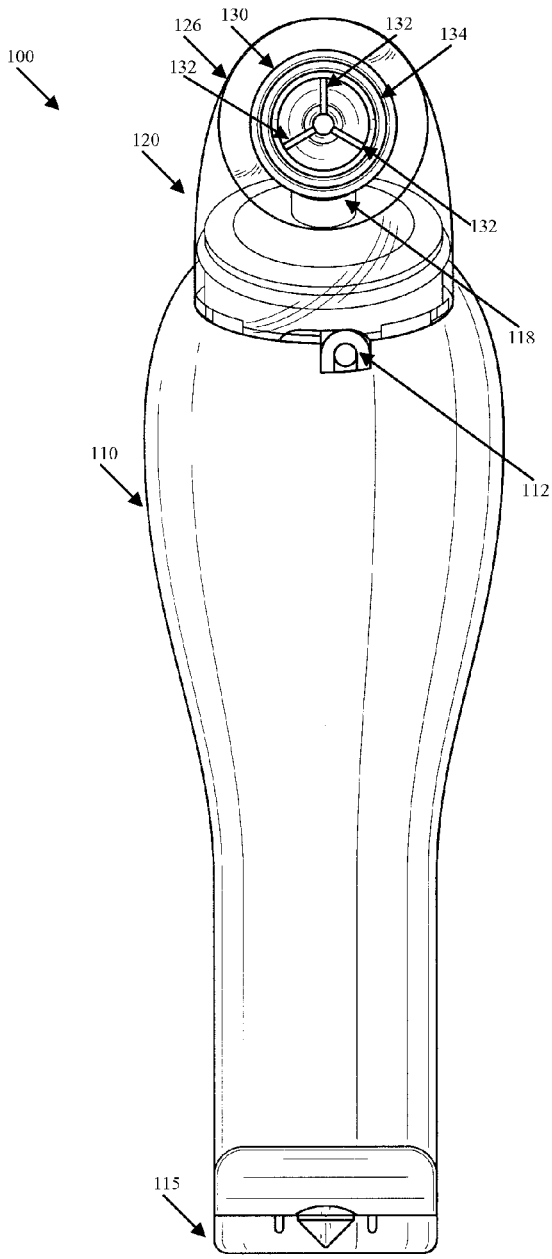
FIG. 2 is a bottom view of an exemplary vacuum pump unit embodiment.
Figure 3:
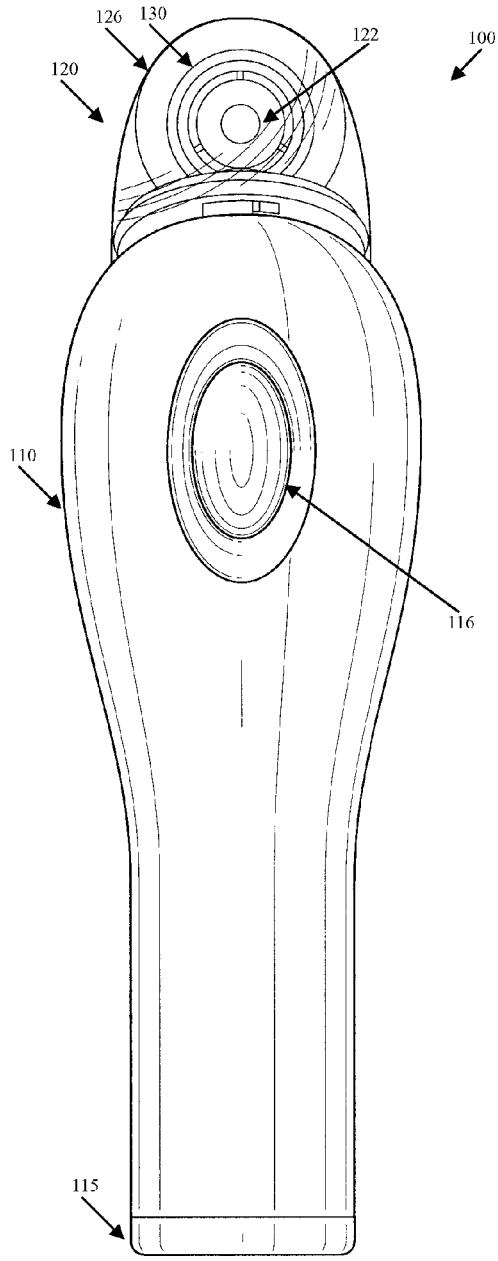
FIG. 3 is a top view of an exemplary vacuum pump unit embodiment.

FIG. 1 is a perspective view of an exemplary vacuum pump unit embodiment 100. FIGS. 2 and 3 provide bottom and top views thereof. The illustrated vacuum pump unit 100 comprises a pump body 110. In an embodiment, vacuum pump unit 100 may be battery powered, and pump body 110 may comprise a removable cover 115 such that a user can change the batteries stored within pump body 110. In an alternative embodiment, vacuum pump unit 100 may utilize one or more rechargeable batteries, and pump body 110 may be sealed to reduce the likelihood that external contaminants may enter pump body 110 and impact the performance of such batteries. In an embodiment, the lower pump surface, illustrated as part of cover 115 in FIG. 3, may be flat or slightly concave, thereby permitting vacuum pump unit 100 to stand on such surface. This can permit the vacuum pump unit to be stored on a countertop or other such location without taking up as much space as if the vacuum pump unit were stored on its side.

Referring again to FIG. 1, pump body 110 may also comprise one or more vacuum pumps of traditional design (not shown). Such vacuum pumps generally have an intake port and an exhaust port. The intake port is the source of the vacuum created by such a pump, and receives gases or liquids (referred to herein generally as "fluids") from a desired source. The received gases or liquids are expelled by the vacuum pump through the exhaust port. In the embodiment illustrated in FIG. 1, pump body 110 comprises an intake port 118 which is in fluid communication with the vacuum pump intake port. Pump body 110 may also comprise exhaust port 112 which is in fluid communication with the vacuum pump exhaust port.

Vacuum pump unit 100 further comprises accumulator 120. Accumulator 120 can be removably coupled to pump body 110. This allows accumulator 120 to be cleaned, and permits access to intake port 118 in the event intake port 118 becomes clogged.

In the illustrated embodiment, accumulator 120 comprises a tip 130, which is in fluid communication with receptacle portion 126 of accumulator 120. As a vacuum is drawn, such as by the user pressing button 116, fluid enters vacuum pump unit 100 through tip 130, and is drawn through receptacle 126 and into intake port 118. In an embodiment, tip 130 may be connected to receptacle 126 by way of a flexible conduit 124. The flexibility of conduit 124 can help tip 130 maintain a proper orientation with respect to any resealable, evacuable containers on which the tip is placed, despite changes in the angle of vacuum pump unit 100 as a whole. In an embodiment, conduit 124 can permit pump body 110 to be moved through approximately one hundred eighty degrees relative to tip 130, without causing tip 130 to become unseated.

After fluid enters tip 130, it may pass through liquid separator 122 prior to reaching intake port 118. Liquid separator 122 can help separate liquids from air or other gases in the fluid, thereby limiting the amount of such liquids that can enter intake port 118.

Figure 4:
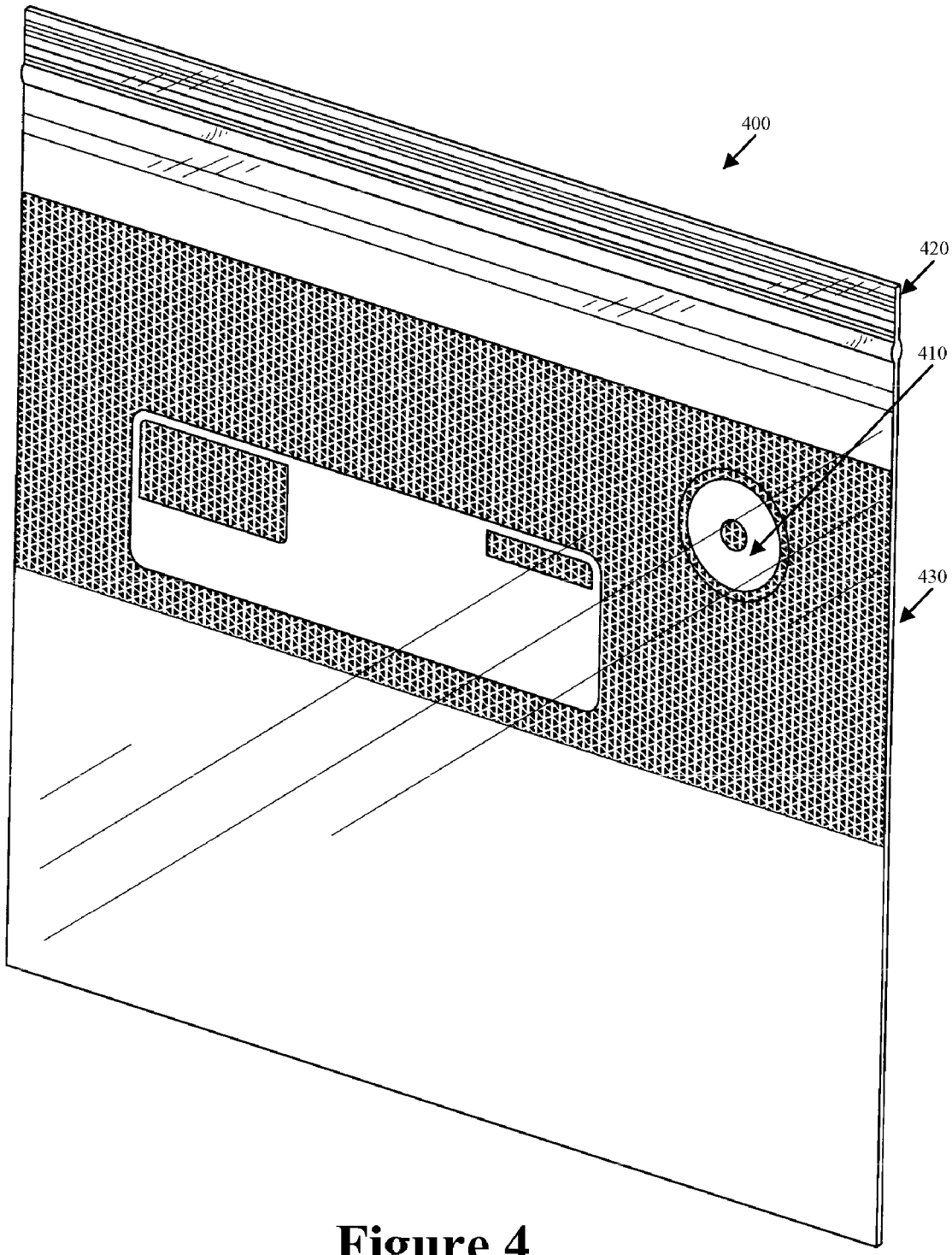
FIG. 4 is a top view of an exemplary resealable, evacuable container embodiment.

FIG. 4 illustrates an exemplary resealable, evacuable container embodiment. In the embodiment illustrated in FIG. 4, container 400 comprises a resealable closure 420. Such a seal may comprise a plurality of interlocking members, such as those described in U.S. patent application Ser. No. 11/186,131, which is incorporated by reference herein. Container 400 may also comprise at least one valve 410, and at least one stand-off structure 430, such as the stand-off structures described in U.S. patent application Ser. No. 11/186,131. Valve 410 can be a one-way valve, which permits fluid to be evacuated from container 200. In an embodiment, valve 410 may be operable only when an external vacuum is exerted thereon.

Stand-off structure 430 can comprise a plurality of interconnected ridges and/or valleys, and can allow fluid to pass from the storage portion of container 400 through valve 410. Stand-off structure 430 can permit such fluid movement despite the shape of any material stored in container 400, and may retain its shape even under vacuum, thereby permitting the sides of container 400 to be drawn tight under vacuum, even proximate to valve 410. Although illustrated as extending across only a portion of container 400, alternative stand-off structure embodiments may be substituted therefor without departing from the spirit or the scope of the disclosed portable vacuum pump. By way of example, without limitation, the stand-off structure may extend from the top of container 400 to the bottom (i.e. "vertically"), rather than horizontally as illustrated in FIG. 2. Similarly, stand-off structure 430 may have a small surface area relative to that of container 400, such as, without limitation, a patch of stand-off structures which are adhesively bonded to container 400 proximate to valve 410. In an embodiment, stand-off structure 430 may comprise a plurality of holes or other perforations through which fluid can pass.

Referring again to FIG. 1, tip 130 may comprise a plurality of ribs or other structural supports 132. Such supports can enable tip 130 to maintain a desired shape, even as a vacuum is drawn. This can allow tip 130 to activate valve 410 of FIG. 4 and to continue such activation as the vacuum is drawn. Supports 132 can also reduce the likelihood that portions of valve 410 will obstruct tip 130.

Figure 5:
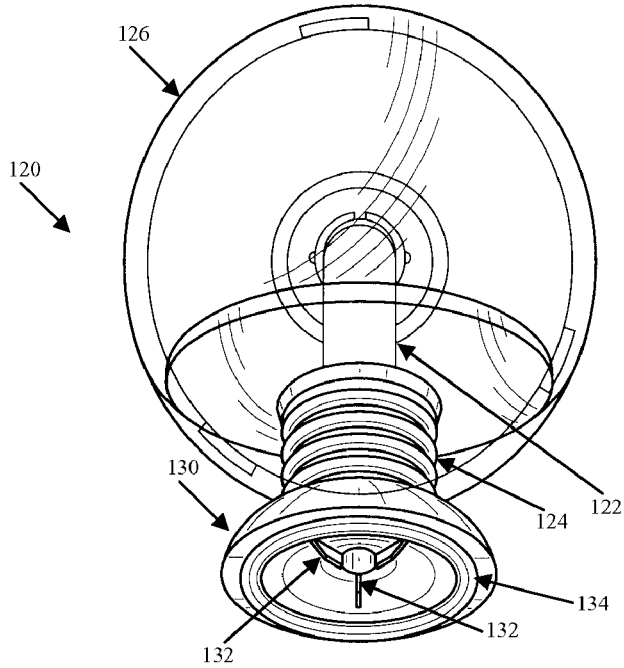
FIG. 5 is a top view of an exemplary accumulator embodiment.
Figure 6:
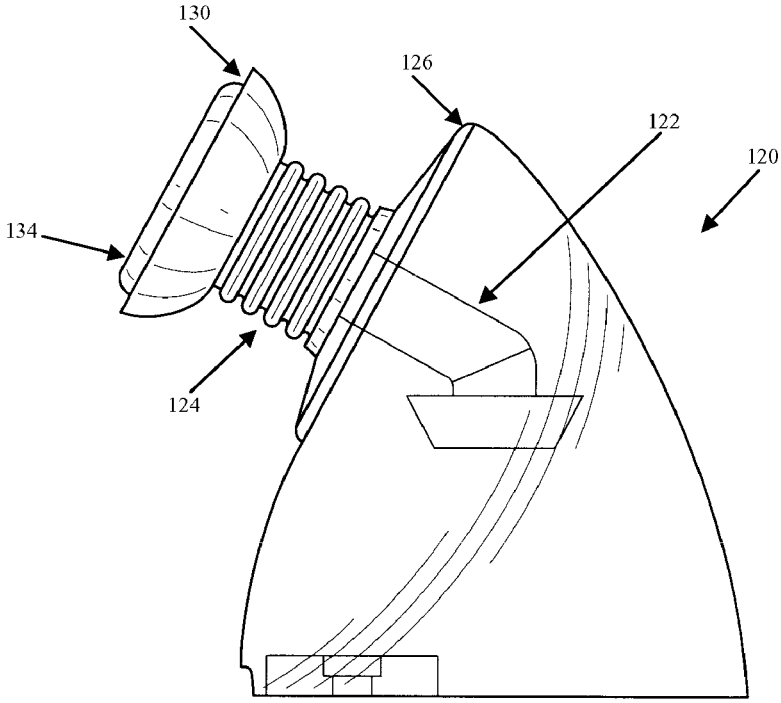
FIG. 6 is a side view of the exemplary accumulator embodiment of FIG. 5.
Figure 7:
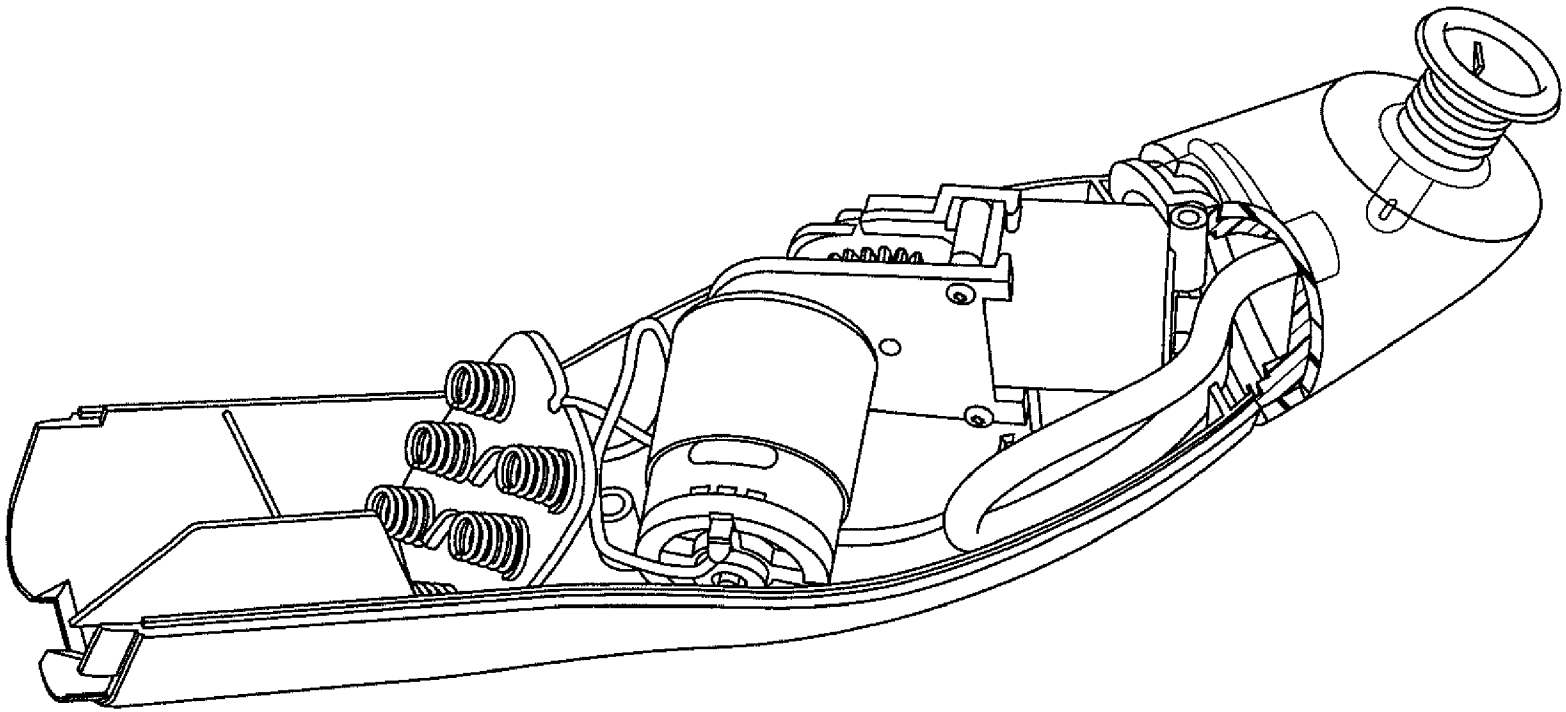
FIG. 7 ia a cross-sectional view of an exemplary vacuum pump unit embodiment.

Tip 130 may also comprise O-ring 134 or other, similar semi-rigid material. The semi-rigid material can extend slightly from tip 130, and thus provide a deformable interface between valve 410 and tip 130. The use of a semi-rigid material on tip 130 can thus permit tip 130 to form a tight seal with valve 410. In an embodiment, O-ring 134 may comprise black nitrile (Buna-N) elastomer with a nominal 70 durometer hardness, silicone, neoprene, or other flexible material, and may be adhesively bonded to tip 130 (as illustrated in FIGS. 5 and 6) or may be press-fit into a channel in or near the end of tip 130 (as illustrated in FIGS. 1-3). In an embodiment, O-ring 134 may be replaced by laminating or otherwise coating at least the end of tip 130 with a semi-rigid material, such as, without limitation, silicone. In an embodiment, the semi-rigid material should be FDA approved as food safe. In an embodiment, the semi-rigid material may be slightly tacky or have an light adhesive applied thereto, thereby helping tip 130 to remain properly positioned proximate to valve 410. In an embodiment, O-ring 134 should fit within tip 130 in a manner which reduces the formation of hidden and/or inaccessible crevices or other openings within tip 130 that might trap any fluids that pass through tip 130.

While detailed and specific embodiments of the vacuum pump interface have been described herein, it will be apparent to those skilled in the art that various changes and modifications can be made therein without departing from the spirit and scope of the vacuum pump interface. Thus, it is intended that the present disclosure cover these modifications and variations provided they come within the scope of any appended claims and/or their equivalents.

The invention claimed is:

1. A portable vacuum unit for use with a resealable, evacuable container, comprising:

a body, wherein a vacuum pump is housed within the body, the vacuum pump comprising an intake port and an exhaust port, wherein the body comprises a vacuum port in fluid communication with the intake port of the vacuum pump, and wherein the body further comprises an exhaust port in fluid communication with the exhaust port of the vacuum pump;

an accumulator, wherein the accumulator is removably coupled to the body and in fluid communication with the vacuum port of the body, the accumulator comprising:

i) a receptacle comprising a first end and a second end; and, ii) a tip comprising a first end and a second end, wherein the first end of the tip is coupled to the first end of the receptacle and in fluid communication therewith, the tip having a shape which facilitates interaction with a valve on the resealable, evacuable container, the tip comprising:

(1) at least one support structure proximate to a second end of the tip; and, (2) a semi-rigid material coupled to the a second end of the tip wherein the receptacle and the tip are both rigid, and the first end of the tip is spatially coupled to the first end of the receptacle by way of a conduit.

2. The portable vacuum unit of claim 1, wherein an adhesive couples the semi-rigid material to the second end of the tip.

3. The portable vacuum unit of claim 1, wherein the semi-rigid material is nitrile.

4. The portable vacuum unit of claim 3, wherein the semi-rigid material is formed as an O-ring.

5. The portable vacuum unit of claim 4, wherein tip further comprises a channel in the second end thereof, wherein the channel is sized to receive and retain the O-ring.

6. The portable vacuum unit of claim 1, wherein the tip comprises a plurality of support structures.

7. The portable vacuum unit of claim 6, wherein the plurality of support structures comprises a plurality of ribs.

8. The portable vacuum unit of claim 1, wherein the accumulator further comprises a liquid separator, wherein the liquid separator is in fluid communication with the tip and the vacuum port of the pump body.

9. The portable vacuum unit of claim 1, wherein the conduit is flexible.

10. The portable vacuum unit of claim 1, wherein the vacuum pump is battery powered, and wherein the body further comprises a battery compartment.

11. The portable vacuum unit of claim 10, wherein the battery compartment houses at least one battery, and wherein the at least one battery is disposable.

12. A portable vacuum unit for use with a resealable, evacuable container, comprising:

a body, wherein a vacuum pump is housed within the body, the vacuum pump comprising an intake port and an exhaust port wherein the body comprises a vacuum port in fluid communication with the intake port of the vacuum pump, and wherein the body further comprises an exhaust port in fluid communication with the exhaust port of the vacuum pump;

an accumulator, wherein the accumulator is removably coupled to the body and in fluid communication with the vacuum port of the body, the accumulator comprising:

i) a receptacle comprising a first end and a second end;

ii) a tip, wherein a first end of the tip is coupled to a first end of the receptacle and in fluid communication therewith, the tip having a shape which facilitates interaction with a valve on the resealable, evacuable container, the tip comprising:

(1) at least one support structure proximate to a second end of the tip; and, (2) a semi-rigid material coupled to the a second end of the tip; and, iii) a liquid separator, wherein the liquid separator is in fluid communication with the tip and in fluid communication with the vacuum port of the pump body wherein the receptacle and the tip are both rigid, and the first end of the tip is spatially coupled to the first end of the receptacle by way of a conduit.

13. The portable vacuum unit of claim 12, wherein an adhesive couples the semi-rigid material to the second end of the tip.

14. The portable vacuum unit of claim 12, wherein the semi-rigid material is nitrile.

15. The portable vacuum unit of claim 14, wherein the nitrile is formed as an O-ring.

16. The portable vacuum unit of claim 15, wherein tip further comprises a channel in the second end thereof, wherein the channel is sized to receive and retain the O-ring.

17. The portable vacuum unit of claim 12, wherein the tip comprises a plurality of support structures.

18. The portable vacuum unit of claim 17, wherein the plurality of support structures comprises a plurality of ribs.

* * * * *